US005253685A

United States Patent [19]

Wolf

[11] Patent Number: 5,253,685

[45] Date of Patent: Oct. 19, 1993

[54] CLAMPING AND FEEDING DEVICE FOR THE MACHINING OF BOLES

[76] Inventor: Johann Wolf, Muhldorf 86, A-4644 Scharnstein (Oberosterreich), Austria

[21] Appl. No.: 867,055

[22] Filed: Apr. 10, 1992

[30] Foreign Application Priority Data

Apr. 24, 1991 [AT] Austria ..... 856/91

[51] Int. Cl.[5] ..... B27B 31/00

[52] U.S. Cl. ..... 144/242 R; 83/708; 144/39; 144/242 B; 144/245 B; 144/378

[58] Field of Search ..... 83/704, 708, 710, 711; 144/242 R, 242 B, 39, 245 R, 245 B, 242 G, 378

[56] References Cited

U.S. PATENT DOCUMENTS 4,353,276 10/1982 Ackerfeldt ..... 83/708
4,466,321 8/1984 Ferguson, Jr. et al. ..... 83/708
4,489,635 12/1984 Cooper ..... 83/708
4,697,487 10/1987 Cameron ..... 144/378
4,949,769 8/1990 Cameron ..... 144/378
5,135,037 8/1992 Wijesinghe ..... 83/708

FOREIGN PATENT DOCUMENTS 1503923 2/1970 Fed. Rep. of Germany .
3709240 9/1988 Fed. Rep. of Germany .

*Primary Examiner*—W. Donald Bray
*Attorney, Agent, or Firm*—Young & Thompson

[57] ABSTRACT

A clamping and feeding device for the machining of boles by machining tools, such as band or circular saws, milling cutters, and the like, in which a carrier slide (5) designed in the manner of a frame is equipped with clamping devices (10, 12, 18, 23) retaining the bole (8) from several sides and can be reciprocated on a profiled support (4) by rollers (6) along a machining station (1) and is supported by guide rails (14).

10 Claims, 2 Drawing Sheets

CLAMPING AND FEEDING DEVICE FOR THE MACHINING OF BOLES

FIELD OF THE INVENTION

The invention relates to a clamping and feeding device for the machining of tree boles by machining tools, such as band or circular saws, milling cutters, and the like, which is guided in reciprocating fashion on a machining station and which consists of a lower support for the bole and of clamping devices engaging the latter from above.

BACKGROUND OF THE INVENTION

Various movable clamping facilities have been known, for example chain conveyors consisting of several parallel-extending chains with drivers, against which the bole is pressed by hold-downs. Slides guided in suspension tracks are frequently employed, seizing the bole at both ends at the front face with disks that can be hydraulically brought into pressure contact and are studded with pins penetrating into the wood. These holding disks are supported at the slide frame to be rotatable and lockable in several positions so that the bole, after each passage past the machining tools, can be swung about its longitudinal axis into a desired angular range. Thereby, four-sided or multiple-sided beams, boards or planks can be cut. This readily operable and versatile workpiece loading facility is, however, also burdened by restrictive drawbacks due to the fact that the bole is freely suspended between its end-side clamping points and shows a marked sag in case of relatively long lengths. Furthermore, vibrations occur in the central zone of the bole leading to great stress, depending on the tool utilized, and resulting in rough cutting surfaces. This fixture can thus be used only for relatively short logs. Also, high-power tools, such as chippers (rotary milling cutters) cannot be employed since the stresses occurring in such a case are too high to be controlled by this device.

A further disadvantage resides in that the clamping disks must have a relatively large diameter in order to ensure adequate hold. The size of the holding disks, however, limits the region of the bole that can be machined. Boards or planks can be cut only from the marginal zones; the clamped-in-place region, covered by the retaining disk, must be processed into beams or must be further machined in a finishing saw facility.

DOS 1,503,923 discloses a clamping device for tree logs using trolleys for retaining means, the log being carried by supports made up of rollers. The guidance of the log while moving past machining tools is unsatisfactory with the known clamping device so that poor cuts are the result.

DOS 3,709,240 describes a holding device consisting of a laterally guided, low beam and clamping arms guided independently of this beam on a vertically adjustable carrier by means of a top rail. This holding device does not ensure an adequately accurate guidance, either, for a bole while moving past a machining station.

SUMMARY OF THE INVENTION

According to the invention, a clamping device of the type described in the introduction is suggested which precludes the above-discussed disadvantages and is suitable to absorb even very high stresses as they occur when using rotary milling cutters. This object has been attained by providing that a carrier slide designed as a frame constitutes, with its lower frame section, the bottom support for the bole whereas there are arranged, on an upper frame section, hold-downs for the bole, as well as rollers for the suspended guidance of the carrier slide on a profiled rail of a supporting frame.

BRIEF DESCRIPTION OF THE DRAWINGS

Additional details of the invention can be derived from the dependent claims and the following description of the clamping and feeding device of this invention with reference to the drawings, illustrating schematically an exemplary embodiment of the invention, wherein:

DETAILED DESCRIPTION OF THE INVENTION

Figure 1:
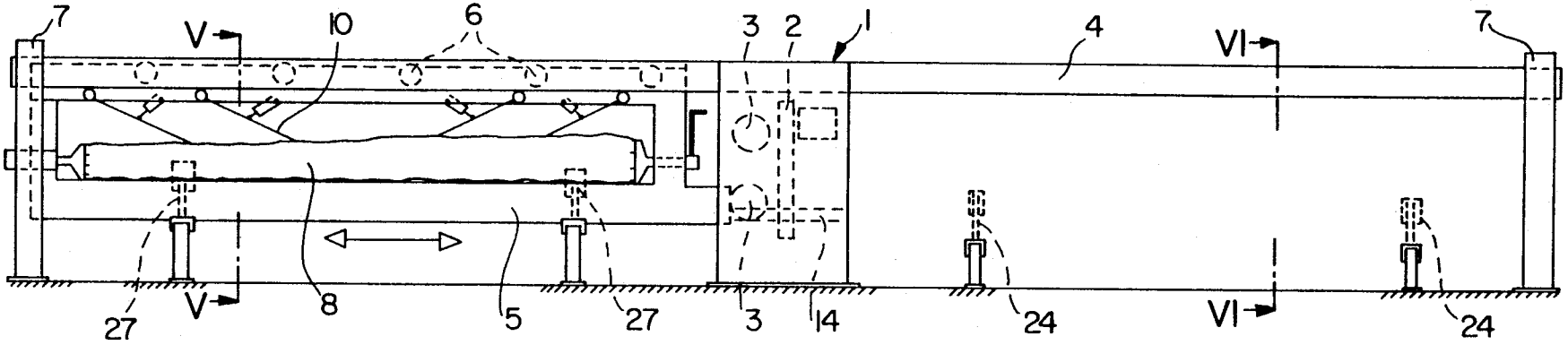
FIG. 1 shows a total view of the clamping and feeding device for machining boles.
Figure 2:
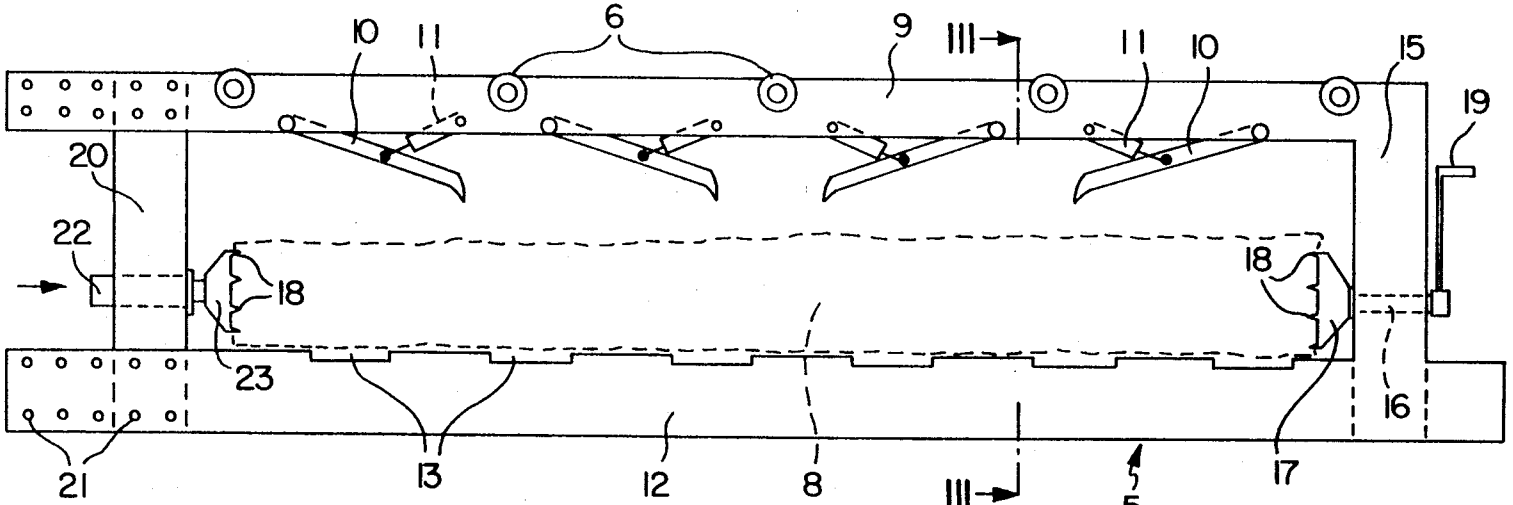
FIG. 2 shows an elevational view of a carrier slide for a bole.
Figure 3:
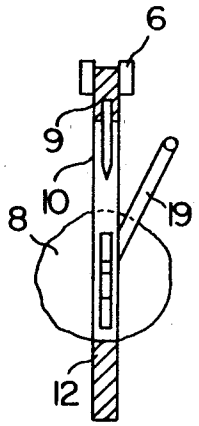
FIG. 3 shows a section along line III—III of FIG. 2.

The device according to this invention has the following structure:

A fixed machining center 1 holding tools, for example a band saw 2 and milling cutter 3 and their drive mechanism, carries centrally at a spacing above the tools a profiled beam 4 serving as guide means for a carrier slide 5. This profiled beam 4 extends beyond the machining center 1 toward both sides at least by the length of the carrier slide 5 and is supported on the ground at the ends by U-shaped supporting frames 7. The carrier slide is guided exactly in the profiled beam 4, for example by means of rollers 6, and is carried by the latter. The forward and backward travel of the carrier slide 5 takes place hydraulically or by means of a tackle. The carrier slide 5 is constructed to be flat and very narrow so that a bole 8 can be machined except for a narrow central section. A top frame section 9 of the carrier slide 5 carries the rollers 6 fitting into the profiled support 4 and serves for the guidance of the carrier slide 5. The upper frame section 9 carrying the rollers 6 is of such a wide dimension that it markedly subtends the profiled beam 4 and serves as a bearing for at least two hold-downs 10 oriented in pairs oppositely to each other. The hold-downs 10 are likewise of a flat structure, and their ends are of spike-shaped construction. Each hold-down is associated with a small hydraulic cylinder 11 effecting the pressure contact of the holders against the bole 8, the cylinders being connected to one another to ensure pressure equalization. The lower frame section 12 of the carrier slide 5 serves as a bearing for the bole 8 and is of a planar design, optionally with spaced-apart recesses 13, and has a thickness of about 3.5 to 5 cm. On account of the recesses 13, noncircular areas of the bole 8, as well as branches or the like, can be more readily accommodated. This frame section 12 is of a wide dimension in order to avoid sagging due to the load resting thereon. The planar and broad design of this frame section 12 serves for guidance in the machining center 1 wherein, on both sides of the frame section 12, guide rails 14 of a synthetic resin, that can be made to engage the section, or adjustable guide rollers are mounted. Thus, the carrier slide 5 is guided at the top and at the bottom directly in the region of the machining tools that trigger the stress.

A right-hand vertical frame section 15 of the carrier slide 5 is connected in force-locking and planar fashion with the upper and lower frame sections 9 and 12 of the slide. A shaft 16 is supported in the vertical frame section 15 approximately at the level of the center of the bole; this shaft carries, on the inside of the carrier slide 5, an approximately triangular plate 17, the end face of which has several spikes 18. On the outside of the vertical frame section 15, the shaft 16 is connected to a long lever 19 permitting the bole 8 to be swung about its longitudinal axis. A left-hand vertical frame section 20 is connected by a threaded connection 21 to the upper and lower frame sections 9 and 12 of the carrier slide 5 and is adjustable in its longitudinal spacing. Coaxially to the aforementioned shaft 16, a hydraulic pressure cylinder 22 is inserted in this frame section 20, carrying on the inside of the carrier slide 5 an analogous plate 23 as the coaxially arranged shaft 16 of the opposite side. With the aid of the pressure cylinder 22, the bole 8 is seized at the end faces by the narrow plates 17 and 23.

Figure 7:
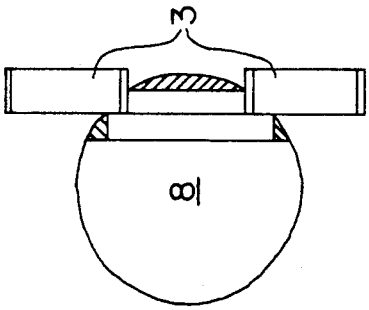
FIG. 7 shows a schematic view of the mode of operation of the device while producing boards.
Figure 4:
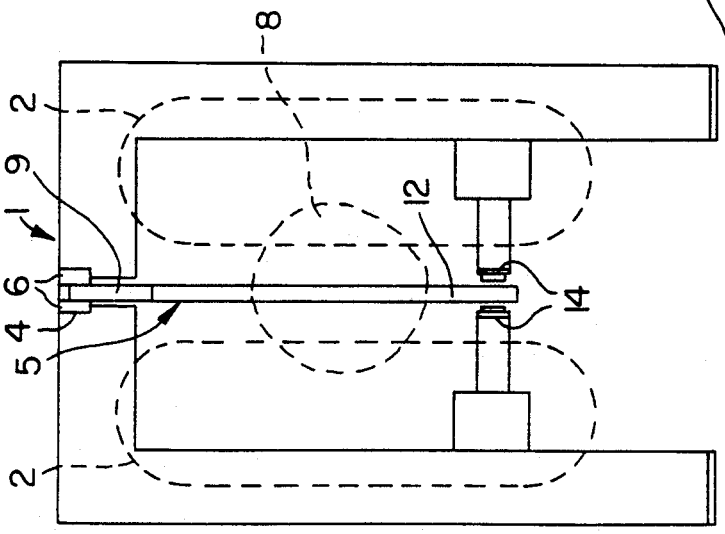
FIG. 4 shows a simplified view of a yoke-shaped machining center seen in the travel direction of the carrier slide.

The boles 8, retained in the carrier slide 5, travels with the latter through the machining center 1, the carrier slide 5 sliding along with exact guidance by the rollers 6 and the guide rails 14 and being supported in the immediate vicinity of the machining tools 2 and 3. In this arrangement, boards or planks are cut off from the bole 8 on both sides, depending on the orientation of the cutting tools, for example the band saws 2. In order to combine the edging (removal of the barrels along both edges) in one operation with the cutting step, rotary milling cutters 3 can be mounted upstream of the cutting tool, performing the edging on the live wood. FIG. 7 illustrates the milling off of the edges (barrels). First the outer barrel (shaded) is cut off the entering bole and, during the next passage, the upper and lower edge barrels are cut off by means of the milling cutters 3 and thereafter, in one operation, the board is cut, and so forth. By means of this device, high throughput efficiencies can be attained wherein the individual runs, such as advance movement of the carrier slide 5 (first cutting step)—return of the carrier slide—orientation of the tool for engagement—second advancement, etc., can be controlled positively by hydraulic or electrical means.

Figure 6:
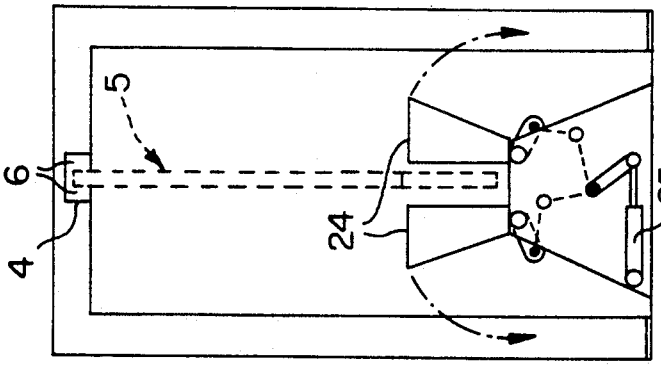
FIG. 6 shows a detail of the device in a section along line VI—VI of FIG. 1.

In the manufacture of beams, boards are first cut off at the opposite sides until the desired beam thickness has been obtained. Then the beam, now cut on two sides, is turned. This is effected by lifting the hold-downs 10 and pivoting the lever 19 attached to the right-hand side of the carrier slide 5, which lever is also, or can be, hydraulically operable. Subsequently, the beam is released by a brief retraction of the axially clamping pressure cylinder 22 on the left-hand side of the carrier slide. The beam thus drops with a machined side onto the lower frame section 12 and is again retained by means of the hold-downs 10 and axially oriented clamping action. In order to prevent the beam from sliding off laterally during the lowering step (about 7–14 cm, depending on the bole thickness) onto the narrow lower frame section 12, supports 24 that can be pulled upwards or folded upwards are provided on both sides of the carrier slide 5 at a small spacing from the latter (see FIG. 6); in the upwardly moved or upwardly folded condition, these supports extend just up to the top edge of the lower frame section 12 of the carrier slide 5 so that temporarily a broadened support is produced. Suitably, the movement of these supports 24 by means of a hydraulic cylinder 25 is coupled with the movement of the hold-downs 10. After the subsequent return of the carrier slide 5, the two still remaining barrels of the bole 8 can now be cut off whereupon the beam is released on all sides and laterally deposited or laterally transported away on a chain conveyor.

Figure 5:
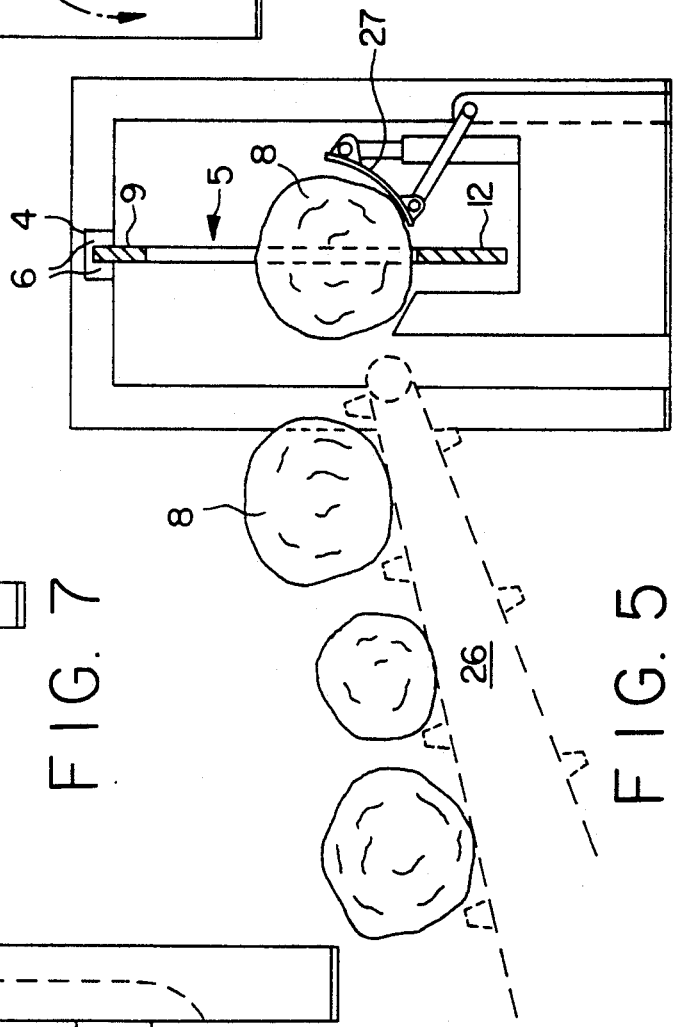
FIG. 5 shows a section along line V—V of FIG. 1, with the boles being loaded onto the carrier slide.

The loading of the carrier slide 5 takes place transversely to its direction of travel by means of chain feeders 26 (FIG. 5). Two chains, arranged in parallel at a mutual spacing, with strong drivers spaced apart in such a way that respectively only one bole 8 can be accommodated between two drivers, conduct the boles at intervals to the carrier slide 5. In order to prevent the boles from rolling away to the opposite side of the carrier slide, two spaced-apart, lowerable supports 27 are provided, by means of which the central placement of the bole 8 onto the carrier slide is determined and/or adjusted. Upon operation of the chain conveyor, these supports 27 travel upwardly and form, together with the lower frame section 12 of the carrier slide 5, a bifurcate holding fixture for the bole 8.

What is claimed is:

1. Clamping and feeding device for the machining of boles by machining tools, said device being guided in reciprocating fashion on a machining station and comprising: a lower support for a bole and hold-downs being arranged at an upper, roller-guided part for guidance along a profiled rail of a supporting frame, a carrier slide (5 having a lower frame section (12), which provides said lower support for the bole (8), and an upper frame section (9) that carries said hold-downs (10) for the bole (8), said upper frame section further carrying rollers (6) for the suspended guidance of the carrier slide (5) on said profiled rail.

2. Device according to claim 1, wherein the hold-downs (10) are operable by means of hydraulic cylinders (11) which are hydraulically connected with one another.

3. Device according to claim 1, further comprising, on vertical frame sections (15, 20) of the carrier slide (5), flat plates (17, 23) that are rotatable and lockable and that are studded with spikes (18), said plates adapted to press against end faces of the bole.

4. Device according to claim 3, wherein one plate (17) is attached to a shaft (16) rotatably mounted in one of the vertical frame sections (15), said shaft carrying a lever (19) for pivoting said one plate (17).

5. Device according to claim 3, wherein one of said plates (23) is located in opposition to the other plate (17), and is connected to a hydraulic cylinder (22) for impressing the spikes (18) into the bole.

6. Device according to claim 3, wherein one vertical frame section (20) includes means for adjustably connecting to the upper and lower frame sections (9 and 12).

7. Device according to claim 1, wherein the lower frame section (12) is provided with recesses (13) distributed over its length.

8. Device according to claim 1, further including guide means (14) arranged laterally of the carrier slide (5).

9. Device according to claim 1, further including, at a loading station laterally of the carrier slide (5), supports (27) in alignment with a top edge of the lower frame section (21) and adapted to be lowerable, and a chain feeder (26) for the boles (8) disposed in opposition to said supports (27).

10. Device according to claim 1, further including, at a turning and delivery station laterally of the lower frame section (12), supports (24) which can be swung inwards and outwards, for the bole (8), said supports having bearing surfaces in alignment with a supporting edge of the lower frame section (12) in an inwardly swung position.

* * * * *